United States Patent [19]

Tatsu et al.

[11] Patent Number: 5,044,233

[45] Date of Patent: Sep. 3, 1991

[54] DEPTH ADJUSTER FOR ROTARY TOOLS SUCH AS SCREWDRIVERS

[75] Inventors: Kunihiko Tatsu; Masao Torigoe; Syoichi Hongo, all of Hikone; Masao Yamamoto, Yasu, all of Japan

[73] Assignee: Matsushita Electric Works, Ltd., Osaka, Japan

[21] Appl. No.: 507,409

[22] Filed: Apr. 11, 1990

[30] Foreign Application Priority Data

Apr. 20, 1989 [JP] Japan ..... 1-102598

[51] Int. Cl.[5] ..... B25B 23/00

[52] U.S. Cl. ..... 81/429; 81/58.3; 81/57

[58] Field of Search ..... 81/429, 451, 58.3, 57, 81/57.11, 57.12, 57.13, 57.14

[56] References Cited

U.S. PATENT DOCUMENTS

| | | | |
|---|---|---|---|
| 1,744,976 | 1/1930 | Levedahl | 81/57.14 |
| 3,460,408 | 8/1969 | Raymond | 81/429 |
| 3,712,352 | 1/1973 | Lafferty, Sr. . | |
| 4,809,572 | 3/1989 | Sasaki | 81/429 |

FOREIGN PATENT DOCUMENTS 63-86975 6/1988 Japan .

*Primary Examiner*—Frederick R. Schmidt
*Assistant Examiner*—Lawrence Cruz
*Attorney, Agent, or Firm*—Stevens, Davis, Miller & Mosher

[57] ABSTRACT

A depth adjuster for a rotary tool such as a screwdriver having a tool bit projecting through a nose provided at the front end of the rotary tool. The depth adjustor comprises a locator sleeve mounted on the nose to project on the front end of the tool in such a manner as to surround the tool bit. The locator sleeve has an internal thread engaged with an external thread on the nose so as to be axially movable relative to the nose and the tool bit as the sleeve rotates about the nose. A lock ring is fitted on the nose to be rotatively fixed but axially movable relative thereto. The lock ring is biased towards the locator sleeve by a spring for locking engagement into the locator sleeve so as to rotatively fix the locator sleeve around the nose, whereby retaining the locator sleeve at a desired axial position relative to the nose. The engagement between the lock ring and the sleeve is such that, when the locator sleeve is forced to rotate about the nose, the lock ring moves axially rearwardly against the spring bias to disengage the locator sleeve from the lock ring, thereby permitting the locator sleeve to rotate freely from the lock ring for adjustment of an axial position of the sleeve relative to the nose. The spring is supported between the lock ring and a rear end of the locator sleeve so that the spring is received and concealed within the locator sleeve together with the lock ring.

2 Claims, 2 Drawing Sheets

40
41
42
43
43
18
17
30
20
25
23
16
10
11

40A
1
64
60
61
62
65
63
16
10
11

DEPTH ADJUSTER FOR ROTARY TOOLS SUCH AS SCREWDRIVERS

BACKGROUND OF THE INVENTION

1. Field of the Invention

The present invention is directed to a depth adjuster for a rotary tool such as a power screwdriver provided at its front end with a nose through which a tool bit projects for tightening fasteners.

2. Description of the Prior Art

Depth adjusters for rotary tools have been known in the art as disclosed in Japanese Utility Model Publication [KOKAI] No. 63-86975 and U.S. Pat. No. 3,712,352. As seen in the prior art, the depth adjuster comprises a locator sleeve attached to the front end of the tool as surrounding a tool bit for abutment against a work surface into which a fastener tightened by the tool. The locator sleeve is threaded on the front end or the nose of the tool to be movable along an axis of the tool bit for adjustment of a depth by which the fastener is tightened by the tool bit. After the depth adjustment is made for a given work, the sleeve is locked into a lock ring rotatively fixed to the nose so that it is inhibited from rotating and therefore moving axially, thereby being held in a position as intended in order to prevent unexpected axial movement of the sleeve. When readjustment of the tightening depth is required, the locator sleeve has to be disengaged from the lock ring so that it can be freely rotatable relative to the lock ring and the nose. A spring is incorporated in the device to give a spring bias for maintaining positive engagement between the locator sleeve and the lock ring such that the depth adjustment is effected by firstly disengaging the locator sleeve from the lock ring against bias of the spring. In the device of Japanese publication No. 63-86975, the lock ring is disposed axially rearwardly of the locator sleeve and is engaged at its front end with the rear end of the locator sleeve. The lock ring is biased toward the locator sleeve by the spring interposed between the lock ring and a tool housing for positive locking engagement between the sleeve and the lock ring. The locking engagement is such that, when the locator sleeve is forcibly rotated with the lock ring being biased toward the sleeve, the lock ring receives from the sleeve from a counter force to be thereby forced to move axially rearwardly against the spring bias, releasing the locator sleeve and permitting it to rotate freely for effecting the depth adjustment. This is found advantageous in a sense that the user is required to manipulate only the locator sleeve with one hand for the depth adjustment while leaving the other hand to hold the tool. Despite this advantageous feature, the device poses a problem that it will add a considerable dimension to the length of the tool because of a tandem arrangement of the locator sleeve and the lock ring along the axis of the tool. Further, since the engaging portion between the locator sleeve and the lock ring is left exposed in this device, it is likely that a foreign matter may enter the engaging portion to be clogged therein or even to damage the engaging portion and also that the finger of the user may be pinched between the locator sleeve and the lock ring during the depth adjustment operation.

The other prior device of U.S. Pat. No. 3,712,352 includes a handle ring which is added between the locator sleeve and the lock ring provided as a fixed member integral with a tool housing. The handle is rotatively fixed but axially movable relative to the locator sleeve and is formed at its rear end with grooves for engagement with corresponding teeth at the front end of the lock ring so that the locator sleeve can be locked in position through the handle ring to the lock ring. Also in this device, the engaging portion between the handle and the lock ring is exposed so that it may be damaged by the entry of foreign matter and may cause the finger pinching thereat during the depth adjustment.

SUMMARY OF THE INVENTION

The above disadvantages can be successfully eliminated in an improved depth adjuster of the present invention. The improved depth adjuster is adapted in use to be mounted on a front nose of a rotary tool such as a screwdriver having a tool bit projecting through the nose for tightening a fastener such as a screw. The adjuster comprises a locator sleeve and a lock ring both mounted on the nose of the tool with a front end of the locator sleeve projecting to define an abutment end for a work surface into which the fastener is tightened. The locator sleeve has an internal thread engaged with an external thread on the nose so that it is movable along an axis of the nose or the tool bit as it is rotated about the nose. The lock ring is disposed within the locator sleeve and is rotatively fixed but axially movable relative to the nose. At a portion axially rearwardly of the internal thread the locator sleeve is formed with a first engaging surface which is engageable with a second engaging surface on the lock ring so as to rotatively fix the locator sleeve relative to the nose. A spring is included to bias the lock ring in order to maintain the engagement between the first and second engaging surfaces for retaining the locator sleeve at a desired axial position relative to the nose. The first and second engaging surfaces are cooperative with each other to define a torque limiting clutch which allows the lock ring to move axially rearwardly against the spring bias when the locator sleeve is forced to rotate, thereby disengaging the first engaging surface from said second engaging surface and permitting the locator sleeve to move axially for adjustment of the axial position thereof relative to the nose. In other words, the depth adjustment or the axial position adjustment of the locator sleeve can be made simply by manipulating only the locator sleeve and without requiring to disengage the lock ring from the sleeve prior to rotating the sleeve. Therefore, the depth adjustor can be easily manipulated with one hand, leaving the other hand of the user free to hold the tool. In addition, the spring is held between the lock ring and the rear end of the locator sleeve so as to be received and concealed within the locator sleeve together with the lock ring. Thus, the clutch or the engaging portion between the locator sleeve and the lock ring can be well concealed within the locator sleeve, preventing the undesired clogging or accidental finger pinching thereat when adjusting the position of the locator sleeve. Further, since the lock ring and the spring are both received within the locator sleeve, the overall length of the adjustor can be reduced to that of only the locator sleeve, in addition to that the user can easily manipulate the locator sleeve without being confused by the other parts.

Accordingly, it is a primary object of the present invention to provide an improved depth adjuster for a rotary tool which is capable of not only adjusting the position of the locator sleeve by one hand but also keeping the clutch harmless from causing the clogging or finger pinching at the time of adjusting the locator sleeve, yet reducing the length of the adjustor assembly to a minimum.

In a preferred embodiment, a retainer ring is press-fitted into the rear end of the locator sleeve so that the spring is supported between the retainer ring and the lock ring as compressed to urge the lock ring to the first engaging surface of the locator sleeve. Thus, the spring and the lock ring are both supported within the locator sleeve so that they will not be disassembled when the locator sleeve is detached from the nose of the tool, which is therefore another object of the present invention.

The present invention may utilize an attachment for mounting the depth adjuster to a tool having no threaded nose. The attachment is secured at its rear end to the front end of the tool and is formed to have a threaded nose for mounting the adjuster by the like thread engagement therebetween.

It is therefore a further object of the present invention to provide an improved depth adjustor which is capable of being successfully mounted to a tool lacking a threaded nose with the use of the attachment.

These and still others objects and advantageous features of the present invention will become more apparent from the following description of the preferred embodiment of the present invention when taken in conjunction with the attached drawings.

DETAILED DESCRIPTION OF THE EMBODIMENT

Figure 1:
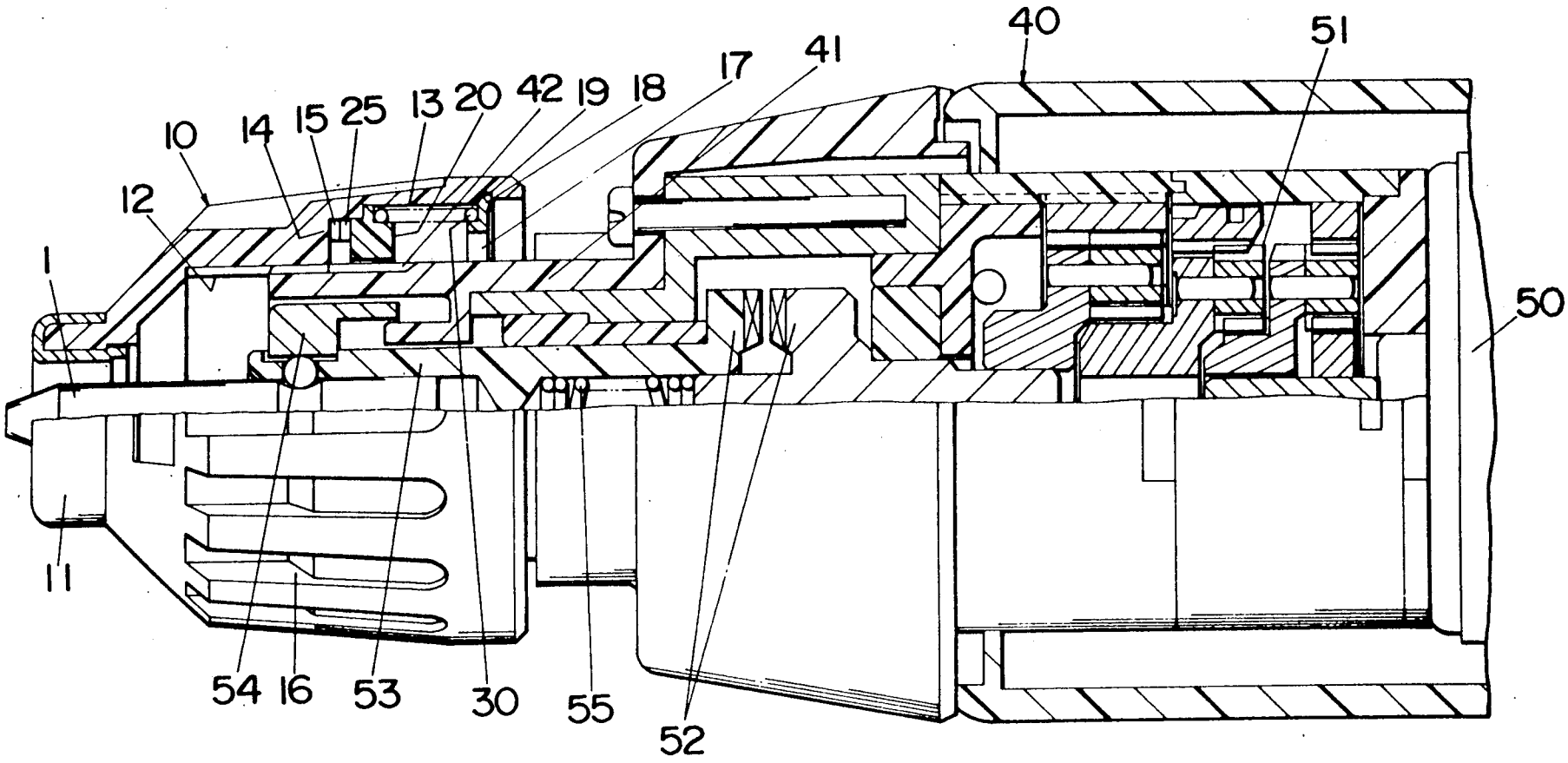
FIG. 1 is a part-sectional view of a depth adjustor in accordance with a preferred embodiment of the present invention, shown as mounted to a screwdriver.
Figure 2:
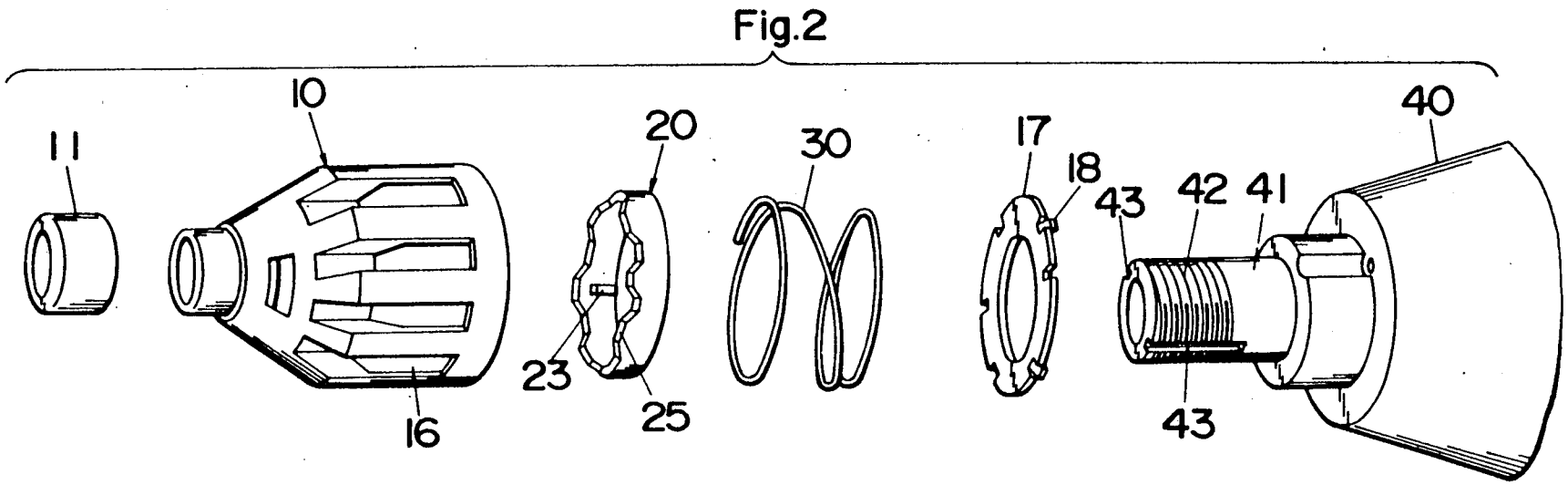
FIG. 2 is an exploded perspective view of the depth adjuster.

Referring now to FIGS. 1 and 2, a depth adjustor of the present invention is shown to be mounted on a front nose 41 of a rotary tool 40 such as a power screwdriver in such a manner as to surround a driver bit 1 projecting from the nose 41. The depth adjustor comprises a locator sleeve 10 threaded on the nose 41, a lock ring 20 received within the sleeve 10, and a coil spring 30 urging the lock ring 20 forwardly along an axis of the tool bit 1 or the nose 41.

The locator sleeve 10 is made from a hard plastic material have an internal thread 12 at the front inner half portion. The sleeve 10 is mounted on the nose 41 by engaging the internal thread 12 with an external thread 42 formed on the nose 41 so that it is movable along the axis of the nose 41 as being rotated thereabout for varying the axial position of the front end of the sleeve 10 relative to the front end of the tool bit 1 and therefore adjusting the depth by which the fastener is tightened into a work surface or wall. The front end of the locator sleeve 10 is fitted with a metal cap 11 for abutment against the work surface. As will discussed in detail, the depth adjustment is made by directly and solely manipulating the locator sleeve 10. To this end, the locator sleeve 10 is knurled on its external surface to have parallel rows of grooves 16 for facilitating gripping of the sleeve 10 by the fingers of the user.

The rear half of the locator sleeve 10 is formed to have a cylindrical recess 13 having an internal diameter greater than the internal thread 12 for receiving the coil spring 30. At the juncture between the internal thread 12 and the recess 13 there is formed a rearward facing shoulder 14 which has a first engaging surface 15 for detachable engagement with a second engaging surface 25 at the front end of the lock ring 20 so as to normally hold the locator sleeve 10 unrotatable relative to the lock ring 20. As seen in FIG. 1, the engaging portion is completely concealed within the locator sleeve 10.

The lock ring 20 is formed with a pair of diametrically opposed guides 23 projecting inwardly for slidable engagement into a pair of axially extending grooves 43 formed in the external thread 42 so that the lock ring 20 is rotatively fixed but axially movable relative to the nose. Consequently, so long as the locator sleeve 10 is locked into engagement with the lock ring 20, the sleeve 10 is inhibited from rotating and is therefore disabled to move axially and kept stable at a fixed position. The lock ring 20 is biased by the spring 30 toward the shoulder 14 of the sleeve 10 for maintaining positive engagement therebetween.

The first and second engaging surfaces 15 and 25 are respectively formed by a plurality of circumferentially spaced cam projections on the shoulder 14 of the sleeve 10 and the front end of the lock ring 20 so that the cam projections on one of the first and second engaging surfaces 15 and 25 are engaged into corresponding grooves formed between the adjacent cam projections of the other engaging surfaces. Each of the cam projections is formed to have tapered sides such that, when the locator sleeve 10 is forcibly manipulated to rotate while it is kept engaged with the lock ring 20, the lock ring 20 is forced to move axially rearward against the spring bias due to interaction between the cam projections, disengaging the sleeve 10 from the lock ring 20 and allowing the sleeve 10 to rotate relative to the lock ring 20 or the nose 41. In this manner, the lock ring 20 repeats to move back and forth against and by the spring bias while the sleeve 10 is forcibly manipulated to rotate about the nose 41, whereby permitting the locator sleeve 10 to rotate in a stepwise manner in order to adjust the axial position of the sleeve 10 relative to the nose 41 or the tool bit 1. In this sense, the first and second engaging surfaces 15 and 25 define a torque limiting clutch which normally interconnects the sleeve 10 and the lock ring 20 and disengages them each time the sleeve 10 is manipulated by the user to rotate relative to the nose 41.

The rear end of the coil spring 30 is received by a retainer ring 17 fitted into the inner periphery at the rear end of the sleeve 10. The retainer ring 17 is formed to have a plurality of anchor tabs 18 around the periphery which are press-fitted into corresponding notches 19 in the rear end of the sleeve 10 for permanently securing the retainer ring 17 to the sleeve 10. Thus, the spring 30 and the lock ring 20 are together supported between the shoulder 14 and the retainer ring 17 so that the adjuster can be constructed as a single unit which cannot be disassembled when it is detached from the nose 41 of the tool. It is noted at this time that since only the sleeve 10 is exposed on the end of the tool, the user can easily manipulate the sleeve 10 in an intuitive manner without being confused by the other parts.

The power screwdriver 40, which is illustrated in FIG. 1 as one example of the tool to which the depth adjuster is adapted, will be only briefly explained below as it is not essential in the present invention. The screwdriver 40 incorporates within a tool housing an electric motor 50, reduction gears 51, a clutch 52, and a spindle 53 to which the screw bit 1 is connected within the nose 41 by means of a chuck 54. The spindle 53 is in turn connected to the motor 50 by way of the clutch 52 and the reduction gears 51. When the screw bit 1 is pressed against the fastener, the spindle 53 is forced back together with the bit 1 to thereby engage the clutch 52 for establishing the driving connection from the motor 50 to the tool bit 1. The spindle 53 is biased by a return spring 55 in the direction of disengaging the clutch 54.

Figure 3:
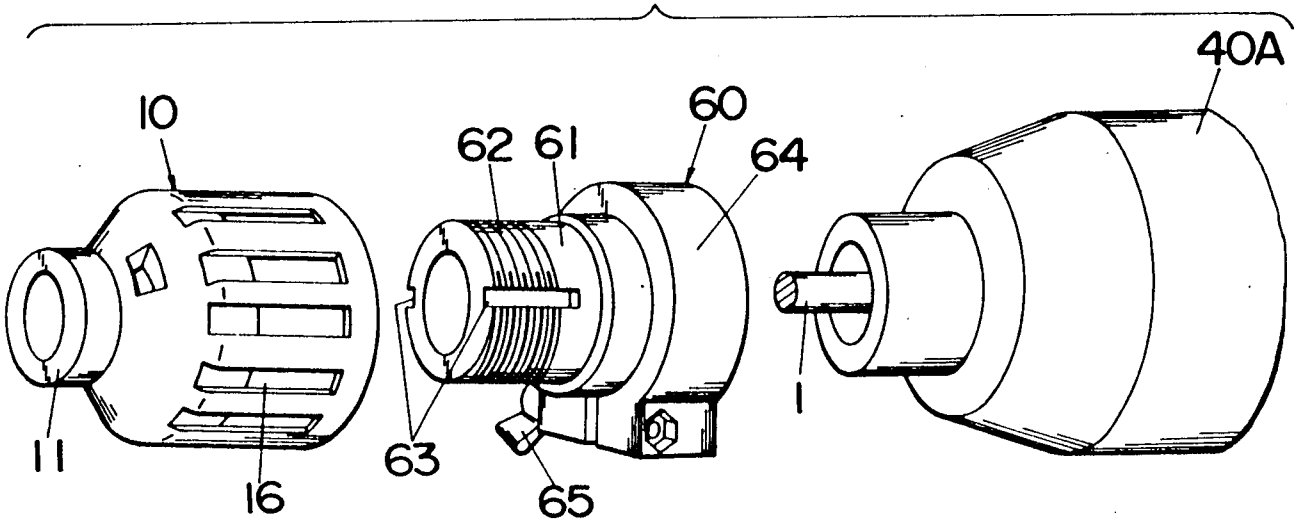
FIG. 3 is a perspective view of the depth adjuster with an attachment for mounting the adjustor to the front end of the screwdriver.

As shown in FIG. 3, the depth adjuster can be equally adapted to a tool 40A without the threaded nose by the use of an attachment 60. The attachment 60 is formed from a hard plastic material to have a nose 61 integrally projecting from a base barrel 64 which is fitted over the front end of the tool 40A and tightened thereto by means of a screw 65. The nose 61 is formed to have an external thread 62 and axial grooves 63 for mounting the locator sleeve 10 and the lock ring 20, respectively in much the same way as described with reference to the nose 41.

What is claimed is:

1. A depth adjuster adapted to be mounted on a rotary tool such as screwdriver, said screwdriver having a nose through which a rotating tool bit projects, said adjuster comprising:

a locator sleeve rotatably mounted on said nose to surround said tool bit, said locator sleeve having an internal thread engaged with an external thread on said nose so as to be movable along an axis of said tool bit as said locator sleeve rotates relative to said nose, said locator sleeve formed in its interior at a portion axially rearwardly of said internal thread with a first engaging surface;

a lock ring attached to said nose within said locator sleeve to be rotatively fixed but axially movable relative to said nose, said lock ring having a second engaging surface for locking engagement with said first engaging surface so as to rotatively fix said locator sleeve on said nose;

a spring biasing said lock ring in the forward direction for maintaining said locking engagement between said first and second engaging surfaces for retaining said locator sleeve at a desired axial position relative to said nose;

said first and second engaging surfaces cooperating with each other to define a torque limiting clutch which allows said lock ring to move axially rearwardly against the bias of said spring when said locator sleeve is forced to rotate, thereby disengaging the first engaging surface from said second engaging surface and permitting said locator sleeve to move axially for adjustment of an axial position thereof relative to said nose;

said spring being held between said lock ring and a rear end of said locator sleeve so as to be received and concealed within said locator sleeve together with said lock ring.

2. A depth adjuster as set forth in claim 1, wherein said nose is formed on an attachment formed separately from said rotary tool and detachably connectable thereto.

* * * * *